US005890230A

United States Patent [19]

Guo

[11] Patent Number: 5,890,230

[45] Date of Patent: Apr. 6, 1999

[54] HAT WITH ELASTIC SIZING BAND

[76] Inventor: Tian-Song Guo, No.80-3, Ryh Nan Road, Dah-Jea Town Tai-Jong Shian, Taiwan

[21] Appl. No.: 948,650

[22] Filed: Oct. 10, 1997

[30] Foreign Application Priority Data

Jan. 29, 1997 [CN] China ..... 86201566

[51] Int. Cl.[6] ..... A42B 1/22

[52] U.S. Cl. ..... 2/175.1; 2/183; 2/184

[58] Field of Search ..... 2/175.1, 183, 181, 2/184, 195.3, 418

[56] References Cited

U.S. PATENT DOCUMENTS 1,660,770 2/1928 Solomon ..... 2/175.1

4,165,542 8/1979 McLaughlin ..... 2/175.1

FOREIGN PATENT DOCUMENTS 155085 12/1920 United Kingdom ..... 2/175.1

*Primary Examiner*—Diana Biefeld

*Attorney, Agent, or Firm*—David E. Dougherty

[57] ABSTRACT

Disclosed is a hat which can be made of multiple pieces or one integral piece of soft material sewed into a hat body having a crown portion and a brim portion. An elastic band is sewed onto and along a lower inner periphery of the crown portion of the hat body in specially patterned stitches to replace the lining band and decorative hat band usually used on a conventional hat. The hat can be folded without becoming deformed. The elastic band provides the hat with adjustable size and tightness to suit to different head shapes and sizes.

1 Claim, 3 Drawing Sheets

HAT WITH ELASTIC SIZING BAND

BACKGROUND OF THE INVENTION

The present invention relates to a structurally improved hat, and more particularly to a hat having an elastic band material sewed around a lower inner periphery of a crown of the hat to replace a lining band inside a conventional felt hat and to save a hat band or ribbon usually used on a conventional hat to cover and decorate sewing threads shown on the hat. The hat according to the present invention can be folded without becoming deformed and can suit to all head shapes and sizes.

FIG. 6 illustrates a conventional hat, in which a part of the hat is cut away to better show an internal structure thereof. To make a hat with crown 1*a* and brim 12*a* in fixed configuration, it is a common practice in early stage methods of making a hat to form the hat by sewing multiple specially cut pieces together. Later, there are fabric containing plastic material developed, such as nylon, allowing the hat to be integrally formed. Either a sewed or an integrally formed hat, it generally has a structure as shown in FIG. 6 without too much change for so many years. A lining band 2*a* is sewed onto and around a lower inner periphery 11*a* of the crown la, making the sewing thread 21*a* visible from outside of the hat. Therefore, a decorative band or ribbon 3*a* is required as an accessory to cover and decorate the crown 1*a*. This makes the production of a hat complicate and troublesome. Moreover, a hat so produced shall have a crown 1*a* having a lower inner periphery 11*a* in a fixed size. So, it is necessary for a hat seller to make the same type of hat in many different sizes for the choice of consumers and to prepare sufficient room for storage of these hats. This is, of course, inconvenient for both the consumers and the hat sellers.

Furthermore, since the lining band 2*a* itself does not have a function of tightening the hat to a wearer's head, the hat so produced tends to be easily blown away from the wearer's head. To prevent the hat from being blown away, a string 4*a* is usually attached to the hat and makes the hat looking ugly. Moreover, the hat with lining band 2*a* and hat band 3*a* is usually made to have fixed shape and not suitable for folding when the hat is not in use. In case the hat is folded, it shall have an irrevocably deformed appearance.

It is therefore tried by the inventor to develop a hat with improved structure to eliminate the above drawbacks found in the conventional hats.

SUMMARY OF THE INVENTION

A primary object of the present invention is to provide a hat which needs fewer accessories to make it and suits to different head shapes and sizes.

Another object of the present invention is to provide a hat which can be folded for convenient carrying and storage without becoming permanently deformed.

To achieve the above and other objects, the hat according to the present invention uses an elastic band fixedly sewed onto and along a lower inner periphery of a crown portion of the hat to replace the conventional lining band and decorative hat band. The elastic band is sewed onto the hat with sewing threads in specially patterned stitches, so that the sewing thread pattern shown on the hat and ruffles and wrinkles formed on the hat by the elastic band directly form a decoration on the hat. The hat of the present invention can be folded without becoming deformed and may suit to different head shapes and sizes.

BRIEF DESCRIPTION OF THE DRAWINGS

The structure and features of the present invention can be best understood by referring to the following preferred embodiments and the accompanying drawings, wherein.

DETAILED DESCRIPTION OF THE PREFERRED EMBODIMENTS

Figure 1:
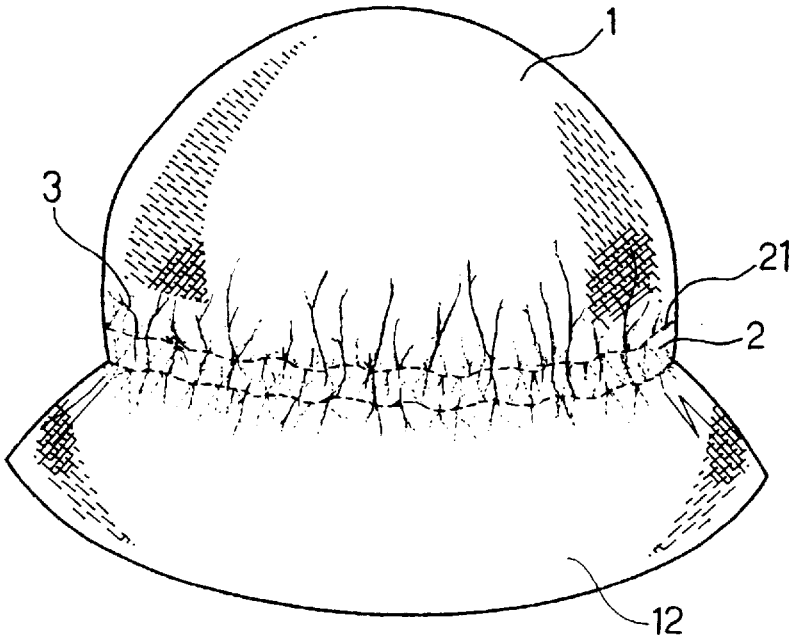
FIG. 1 is a perspective of a hat according to a preferred embodiment of the present invention.
Figure 2:
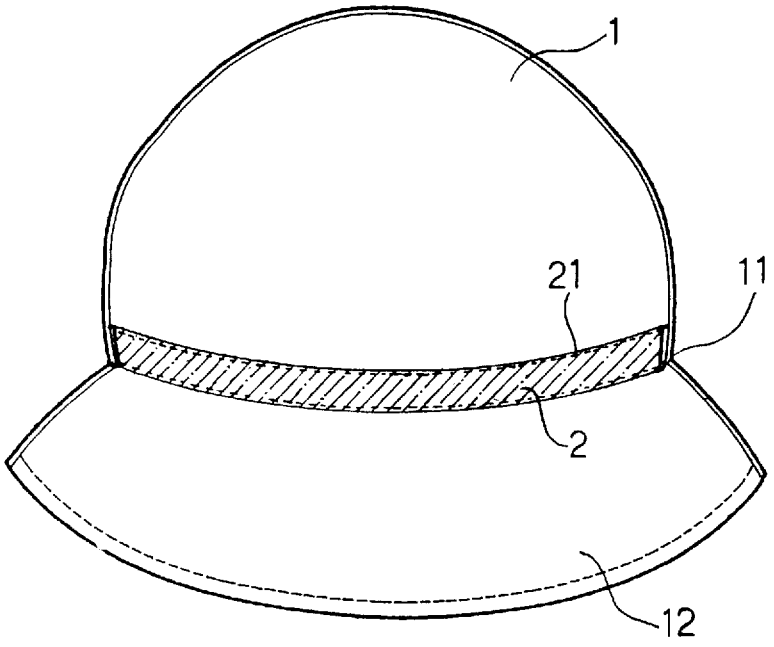
FIG. 2 is a sectional view of the hat of FIG. 1.

Please refer to FIGS. 1 and 2 which are perspective and sectional views, respectively, of a hat according to the present invention. The hat of the present invention mainly includes a hat body 1 and an elastic band 2.

The hat body 1 is formed either by sewing several pieces of particularly cut soft material together or from an integral piece of specially cut soft material. In either way, the hat material is then sewed to present a crown portion 1 having a lower peripheral portion 11, and a brim portion 12 extending from the lower peripheral portion 11 of the crown portion 1.

The elastic band 2 has a predetermined width and is fixedly sewed onto and along an inner side of the lower peripheral portion 11 in specially patterned stitches 21, so as to replace a lining band conventionally used in a hat. No other decorative hat band or ribbon is used outside the hat of the present invention to cover an area beneath where the elastic band 2 is sewed.

Figure 3:
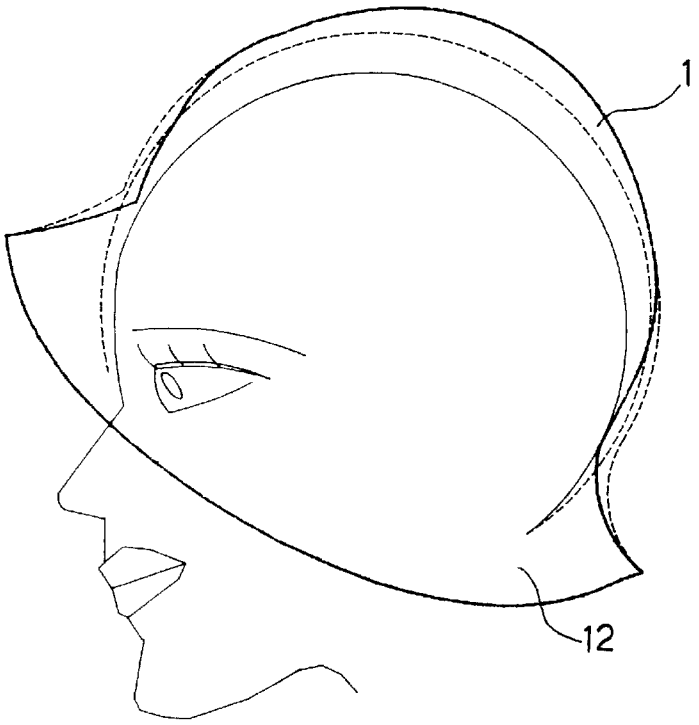
FIG. 3 is a schematic view showing the hat of the present invention may suit to different head sizes.

The hat produced according to the present invention has a structure which eliminates the conventional lining band and decorative band and therefore saves a lot of cost and time for making and sewing such lining and decorative bands. With an elasticity of the elastic band 2, the lower peripheral portion 11 of the crown portion 1 of the hat is suitably tightened by the elastic band 2. When the hat is worn on a head as shown in FIG. 3, the elastically tightened lower peripheral portion 11 prevents the hat from being easily blown away. Moreover, the elastic lower peripheral portion 11 allows the hat to have a size-adjustable crown portion 1 and can therefore suit to wearers having different head shapes and sizes. A consumer may easily and conveniently select a hat without worrying too much about an exact and suitable size. On the other hand, a hat manufacturer may largely simplify specifications for hats. To produce a hat with a conventional structure, at least five to six different sizes are required to suit various head shapes and sizes. However, with the hat of the present invention, only three specifications, that is, large (L), middle (M), and small (S), will be sufficient to cover almost all head sizes. The hat of the present invention is therefore more practical in use than the conventional hats.

Figure 4:
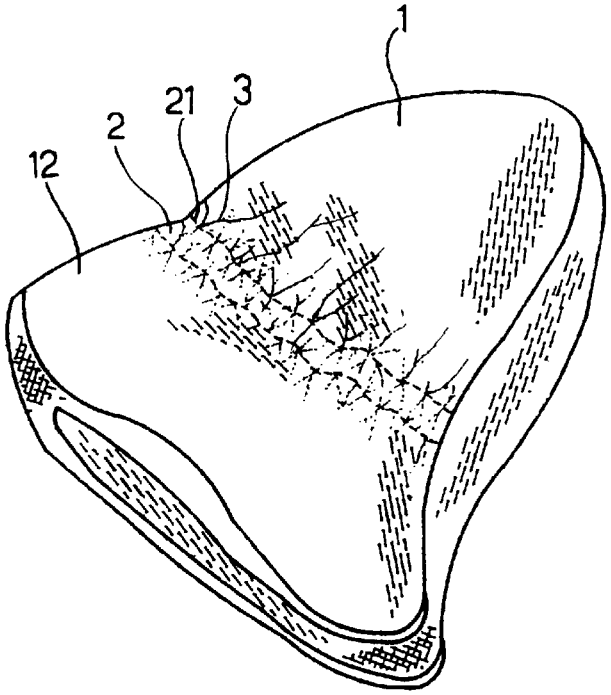
FIG. 4 shows the hat of the present invention in a folded state.

Since the hat of the present invention is made without using the conventional lining band, it can be freely folded as shown in FIG. 4. What is more important is the folded hat can be extended again for use at any time without becoming permanently deformed. This is an advantage of the hat of the present invention that can not be found from a hat, particularly a felt hat, made in conventional manner.

Figure 5:
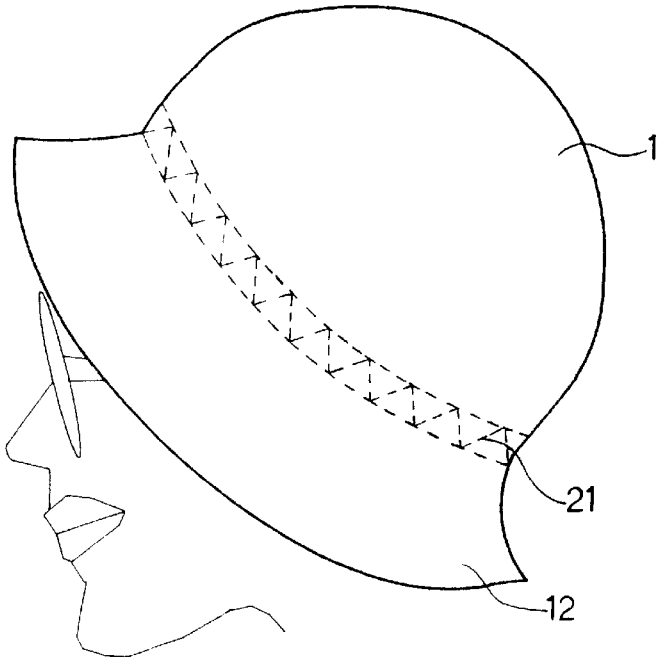
FIG. 5 shows a hat of the present invention with an elastic band sewed to the hat in specially patterned stitches.
Figure 6:
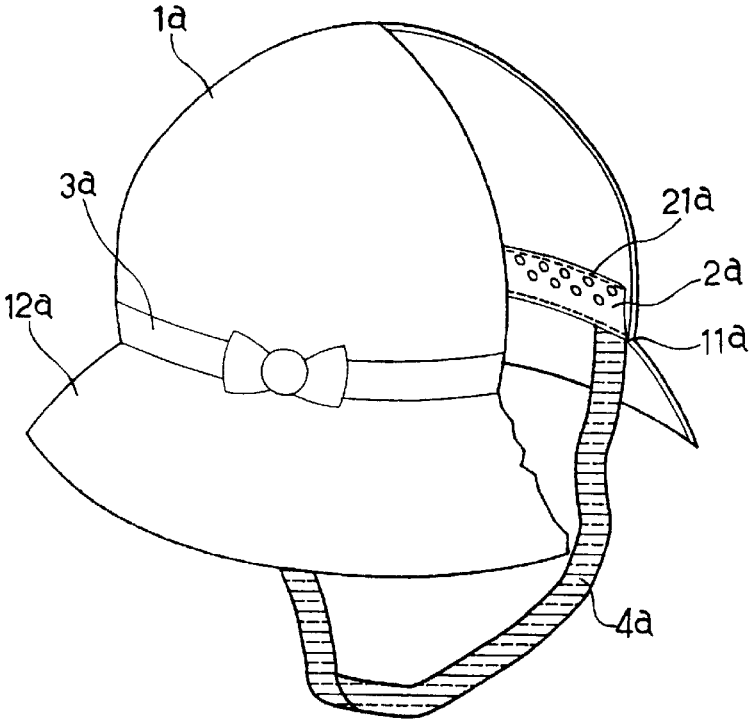
FIG. 6 PRIOR ART
FIG. 6 is a hat produced in conventional method, wherein a part of the hat is cut away to better show an interior structure thereof.

Please now refer to FIG. 5. Although the elastic band 2 sewed along the inner side of the lower peripheral portion 11 shall ruffle the hat body 1, the hat shall return to a substantially smooth appearance once it is worn on a head and the elastic band 2 is stretched. There might be some small wrinkles left on the hat body 1 and they will only form some kind of decorative lines 3 on the hat. When the elastic band 2 is sewed onto the hat body 1 with colored threads and in specially patterned stitiches 21, such as a wave patterned stitches as shown in FIG. 5, a hat with a specific style can be produced to create an absolutely wonderful ornamental effect even better than that created by the hat band or ribbon on a conventionally produced hat.

Following are the advantages of the hat according to the present invention:

1. The hat is economically beneficial because it needs fewer accessories and therefore requires lower cost and less time to manufacture it.
2. Consumers may conveniently find a hat in suitable size and manufactures may simplify the production specifications (to three sizes of L, M, and S only). Moreover, the hat can be folded for easily carrying or storage.
3. The elastic band is sewed along the lower inner edge of the crown portion to provide adequate and adjustable tightness against the wearer's head, preventing the hat from being easily blown away. No other string is required to attach to the hat.
4. The elastic band sewed along the lower inner edge of the crown portion creates natural and decorative ruffles and wrinkles and allows the hat to be folded for convenient carrying.
5. The hat can be folded without becoming deformed and suits for wearing during sleep to keep head warm in cold areas or for special patients.

With the above arrangements, the hat according to the present invention has simple structure to allow easy production at lower cost and can be folded to reduce storage room, and is therefore economical and practical for use.

What is to be noted is the form of the present invention shown and disclosed is to be taken as a preferred embodiment of the invention and that various changes in the shape, size, and arrangements of parts may be resorted to without departing from the spirit of the invention or the scope of the subjoined claims.

What is claimed is:

1. A hat comprising:

a hat body made of a single piece of soft material which is sewed to form a crown portion having inner and outer surfaces and a lower periphery, and an integral brim portion extending from said lower periphery of said crown portion;

a plurality of stitches and an elastic band having a predetermined width sewed on to said inner surface along said lower periphery of said crown portion of said hat body by said plurality of stitches;

said stitches forming a wave-like design along the lower periphery of said crown portion of said hat; and said elastic band providing said hat body with a suitable tightness against a wearer's head to prevent the hat from being easily blown away and to allow said hat to conform to different head sizes and shapes.

* * * * *

UNITED STATES PATENT AND TRADEMARK OFFICE

CERTIFICATE OF CORRECTION

PATENT NO. : 5,890,230

DATED : April 6, 1999

INVENTOR(S) : Tian Sung Kuo

It is certified that error appears in the above-identified patent and that said Letters Patent is hereby corrected as shown below:

Title page, item [76], the inventor's name should read --Tian Sung Kuo--

Signed and Sealed this

Fifth Day of December, 2000

*Attest:*

*Attesting Officer*

Q. TODD DICKINSON

*Director of Patents and Trademarks*